United States Patent [19]

Mitchell, Jr. et al.

[11] Patent Number: 4,719,928

[45] Date of Patent: Jan. 19, 1988

[54] METHOD AND APPARATUS FOR DETERMINING STEM CONTENT OF BALED TOBACCO

[75] Inventors: James M. Mitchell, Jr., Lewisville; Hoyt S. Beard, Winston-Salem; Jerry R. Joyce, Kernersville, all of N.C.

[73] Assignee: R. J. Reynolds Tobacco Company, Winston-Salem, N.C.

[21] Appl. No.: 723,431

[22] Filed: Apr. 15, 1985

[51] Int. Cl.[4] ..... A24B 5/06

[52] U.S. Cl. ..... 131/312; 131/313

[58] Field of Search ..... 131/312, 313, 322, 323

[56] References Cited

U.S. PATENT DOCUMENTS 4,233,996 11/1980 Brackmann et al. ..... 131/313
4,566,470 1/1986 Brackmann et al. ..... 131/312
4,618,415 10/1986 Vecchio et al. ..... 131/313
4,672,982 6/1987 Vigg ..... 131/313

*Primary Examiner*—V. Millin
*Attorney, Agent, or Firm*—S. M. Bodenheimer, Jr.

[57] ABSTRACT

An apparatus for determining the stem content of a mass of plant leaves including a size reduction and classifying mechanism for separating the leaves into a stem and lamina portion and a means for introducing the leaves into the reduction and classifying mechanism. A dryer is utilized to reduce the moisture to a proper content for separation and classifying. The separated stem and lamina portions are transported to a scale mechanism which weighs the separated stem and lamina portions to permit calculation of the stem content of the leaf mass.

7 Claims, 6 Drawing Figures

METHOD AND APPARATUS FOR DETERMINING STEM CONTENT OF BALED TOBACCO

The present invention relates to an apparatus for automatically determining the stem content of a sample of tobacco strips or leaf permitting a more accurate adjustment of the threshing and stemming operation to produce a more uniformly acceptable product.

Presently, the stem content of tobacco samples is determined in a discontinuous manner which causes an excessive delay between the time the sample is taken and the adjustment of the stemming operation. Normally, as a bale of tobacco strip is discharging from the stemming operation, a core sample is taken from the bale. The sample is broken up by hand and placed in an oven. The oven is heated to a specified temperature and held for approximately 8 minutes, thereby drying the sample to a specific moisture content. The dried sample is removed from the oven and placed in a screening mechanism where the lamina is removed and separated from the stem portion of the sample. The separated lamina and stem are removed separately from the screening system and weighed and the stem content of a sample is determined. Each of the above steps are carried out manually and the time delay between taking the sample from the bale and obtaining the results can be excessive. Furthermore, the manual manipulation of samples and data sometimes results in human error which affects the accuracy of the stem content information fed back to the stemming line.

Stemmeries normally operate to produce a product that has a specified maximum stem content. Should the stem content of a particular sample exceed the maximum limit or be too low, the air flow in the pneumatic separator section of the stemming processes can be adjusted, thereby the amount of stem removed during processing can be increased or decreased. In this way. the stem content of the final product should remain uniform.

The stem content of tobacco which is to be used to produce cigarettes is important for several reasons. At the manufacturing level, if the stem content of the tobacco is too great, irregular draft readings or other controlled parameters cause the cigarettes to be rejected. Also, consumers object to cigarettes having high stem content because stems cause irregular burning of the cigarette and holes are sometimes punched in the cigarette wrapper resulting in irregular draft characteristics.

Therefore, a need exists for a method and apparatus for determining the stem content of tobacco that will significantly reduce the delays and human error associated with previously known manual method.

SUMMARY OF THE INVENTION

It is, therefore, an object of this invention to provide a method and apparatus which will reduce the time delay in obtaining stem content results from a specific strip tobacco sample.

Another object of this invention is to provide a system which will determine the stem content of a tobacco strip sample without the necessity of manually handling the sample and data at each stage of the operation.

These and other objects of the present invention are accomplished by an apparatus having a coring device for removing a sample of strip tobacco from a tobacco bale and placing the sample in a milling device. In the milling device the sample is broken apart for pneumatic transfer to a drying, cooling and classifying mechanism. In the drying mode, heated air brings the sample to a specified moisture content generally assumed to be 0% (by weight) moisture. The drying mode is followed by a cooling mode in which the heat source is automatically turned off and ambient air is used to lower the sample temperature to facilitate the classifying process. In the classifying mode, the lamina is removed from the stem fractions and separated into portions. Each portion is sequentially discharged onto the weigh scale. The output signals from the weigh scale are transmitted to a processor which calculates the stem content of the sample so that the stemming operation can be adjusted either manually or automatically.

DESCRIPTION OF THE PREFERRED EMBODIMENT

Figure 1:
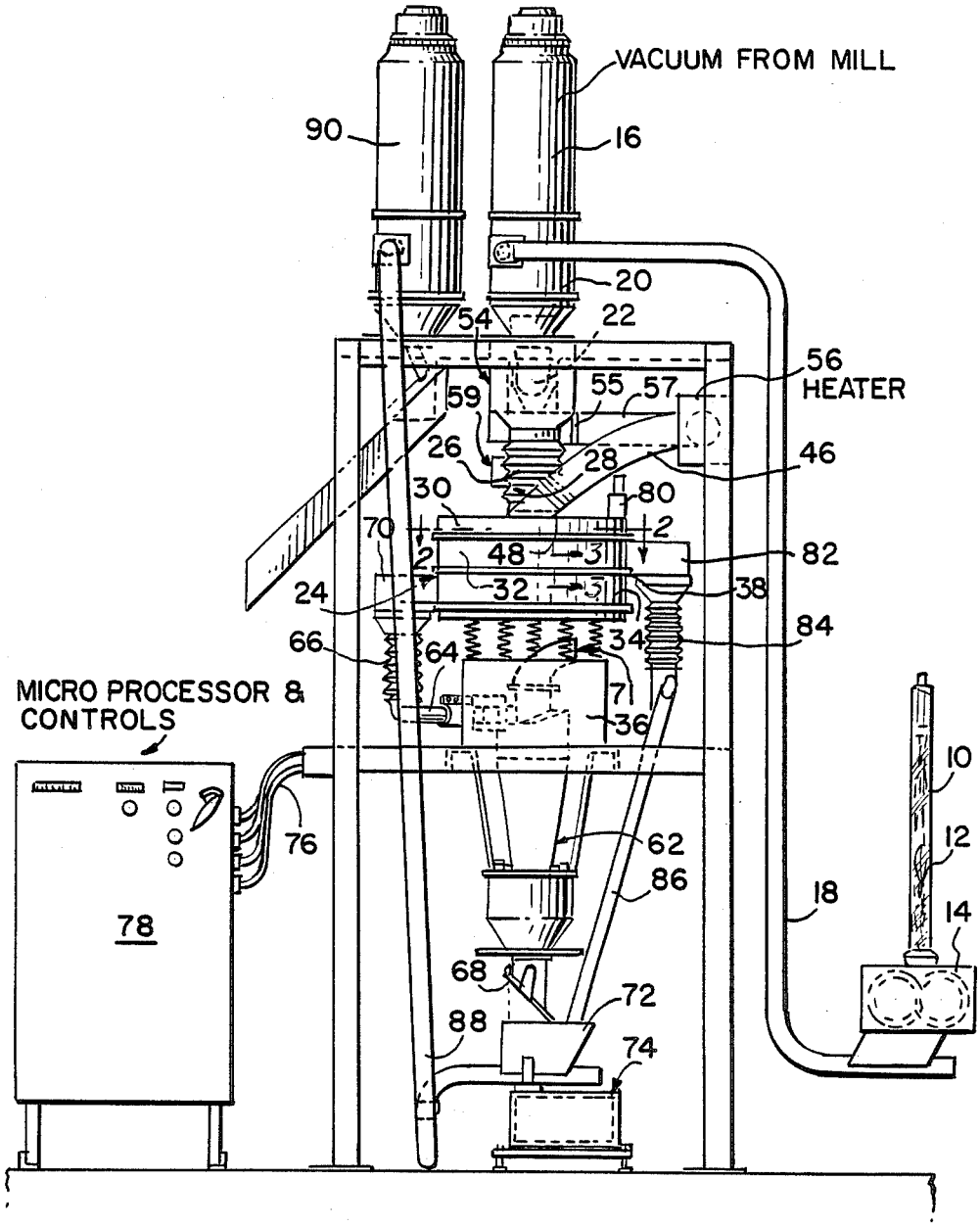
FIG. 1 is a front side elevation of the stem content analysis apparatus according to the present invention.
Figure 1A:
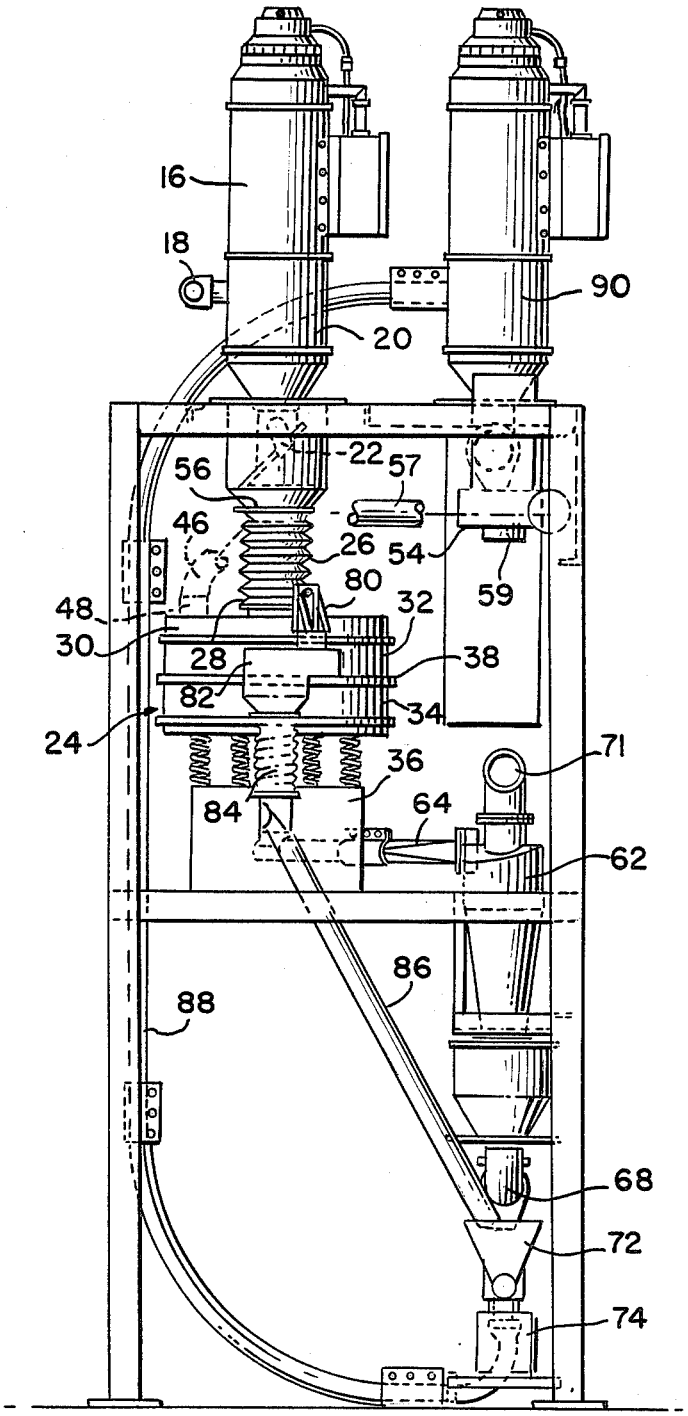
FIG. 1A is a right side elevation of the stem content analysis apparatus.

In FIG. 1, the numeral 10 indicates a coring tube with a sample 12 carried therein. The sample is preferrably 200 grams and is taken from a compressed bale of strip or leaf tobacco (not shown). Sample 12 is removed from the coring tube and deposited in a milling or threshing device 14 where the compressed sample is broken apart. The output of the threshing device is transported pneumatically by a vacuum source 16 via conduit 18 to a chamber 20. After the entire sample has reached the chamber 20, the vacuum pump 16 is deactivated which opens gate valve 22 and the sample 12 falls from chamber 20 into a drying, size reduction and classifier mechanism 24. The chamber 20 is connected to the classifier mechanism 24 via a flexible conduit 26 which is secured to a center conduit 28 extending through an air plenum cover 30. The plenum cover is secured to an upper chamber 32 of the classifier mechanism. The upper chamber is carried on a lower chamber 34 which in turn is attached to a vibrating or driving device 36 used to agitate the classifier mechanism in an orbital and vertical motion to cause material in the classifier to spiral outwardly to the wall of chambers.

Figure 3:
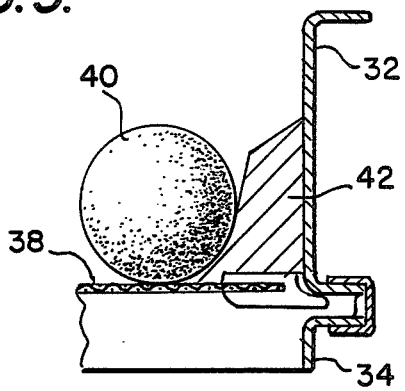
FIG. 3 is a section view taken along line 3—3 of FIG. 1.
Figure 4:
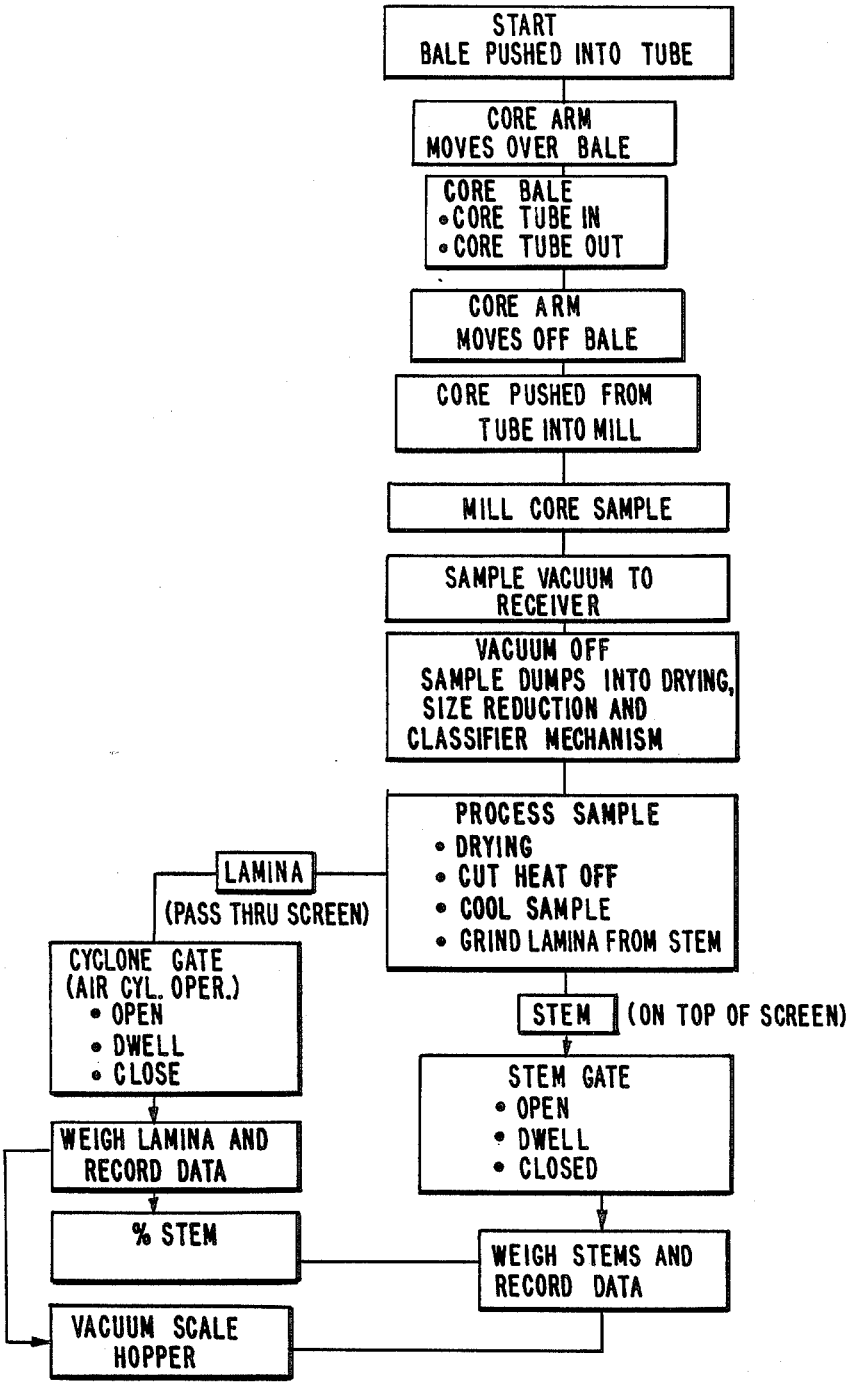
FIG. 4 is a block diagram illustrating the mode for operation of the stem content analysis apparatus.

Positioned between the upper and lower chambers 32 and 34 is a screen 38 which in this preferred embodiment is a No. 11 mesh (0.073" opening) screen that is one standard used in the tobacco industry to separate stem and lamina for a stem content determination. A plurality of balls 40 (see FIG. 3), normally of a rubber substance, are carried in the upper chamber 32. The orbital and vertical motion produced by the drive 36 causes the balls in the classifier's upper chamber 32 to bounce and strike the sample carried on the screen 38. A fillet 42 (see FIG. 3) having a curved radius generally the same as the ball 40 circumscribes the upper chamber at the juncture between the screen 38 and the side wall of the upper chamber 32. The fillet prevents material from being trapped or hiding to ensure the entire sample is processed.

In order to process the sample properly, it must be dried to a specific moisture content of 0% as mentioned above. The dried sample breaks apart more easily and permits the lamina to be removed from the stem. It has been found that a temperature of between 200°–300° at an air flow rate of 100–200 cfm for approximately 5 minutes will properly dry the sample. Other temperatures and treatment times can be used and the temperature will increase as the time decreases. It is important to keep the time interval as low as possible so that the analysis can be completed in the optimum time. Nevertheless, the time interval used must be such that the temperature required does not degrade the tobacco or the system components.

Figure 2:
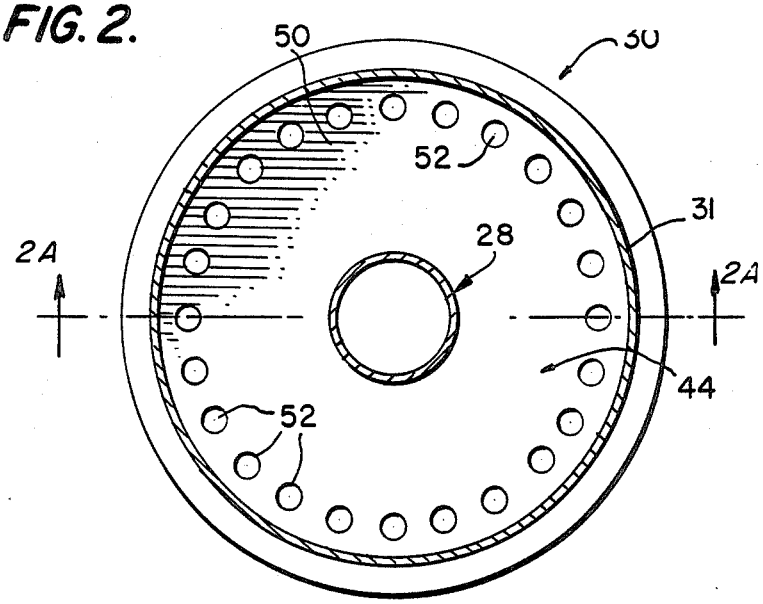
FIG. 2 is a section view taken along line 2—2 of FIG. 1.
Figure 2A:
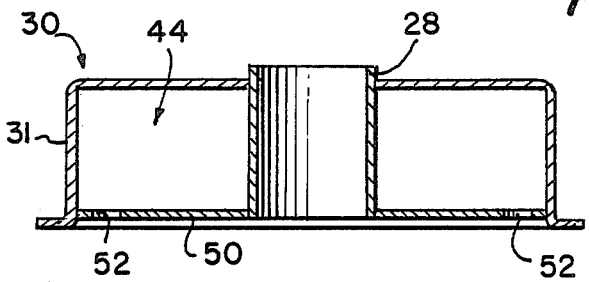
FIG. 2A is a section view taken along line 2A—2A of FIG. 2.

The sample 12 is dried by directing heated air to the upper chamber 32. The air plenum cover 30 has an annular space 44 between its side wall 31 and the center conduit 28 into which the heated air is directed through a flexible conduit 46 that is attached to an inlet opening 48 in the top of the cover 30. The bottom plate 50 of the cover 30 has a plurality of peripherally positioned apertures 52 (see FIGS. 2 and 2A) which disperse the heated air throughout the upper chamber 32. The airflow is a one pass open system. The positive output 55 of a fan 54 connects through flexible conduit 57 to a controlled heater 56. The positive air passing through the heater and the heated output is directed through a flexible conduit 46 and opening 48 into the plenum cover 30. The negative side 59 of the fan 54 is to ambient air or is connected through another flexible conduit (not shown) to scavenge wasted heat from the heat source. The inlet 64 of the cyclone separator 62 is connected via flexible conduit 66 to an outlet 70 of the lower chamber 34. The air leaves the system through an outlet 71 of the cyclone separator 62.

At the lower end of separator 62 is a valve 68, operated by an air cylinder (not shown), which permits lamina material separated from the air stream to be removed from the unit. At an appropriate time during processing, the material drops from the separator through valve 68 into container 72 which is carried on a weigh scale 74. The weigh scale generates a signal which is transmitted via cable 76 to processor 78. The processor stores the weigh scale reading for comparison with subsequent readings.

The upper chamber 32 has a gate valve 80 which is normally in the closed position to prevent the stem material from exiting the chamber. At an appropriate time in the process cycle, the gate valve 80 is opened and the stem material in the upper chamber is discharged through outlet 82, flexible conduit 84, and conduit 86 into the container 72. The stem and lamina material are weighed together and this information sent to the processor 78 where the stem content is calculated and displayed on a digital readout of a control panel A vacuum hose 88, connected to a vacuum source 90, is used to remove the finished sample from the weigh hopper 72 for receipt of the next sample processing cycle. Other arrangements for removing the sample can be provided and are within the skill of the art.

In operation, a sample 12 is taken from a compressed bale and dropped into the hammer mill device 14 where the clumps are broken apart. The sample is then pneumatically conveyed from the mill through a conduit 18 to the chamber 20. When the entire sample has reached chamber 20, the vacuum source 16 is deactivated. The sample drops through the valve 22, conduit 26 and center conduit 28 into the upper chamber 32. Air is blown by fan 54 through the heater 56 into the plenum cover 30 where the air is dispersed into the upper chamber to dry the sample to a specific moisture content. After a predetermined time, depending on the heated air temperature, the heater 56 is activated and ambient air is passed into the chamber 32 by fan 54 to cool the sample to a temperature suitable for further processing. The drive mechanism 36 moves the screen system orbitally and vertically causing the balls 40 to bounce and crush the dry leaf material. The lamina portion of the tobacco is broken away from the stem and passes through the screen 38 either as small particles or dust into the lower chamber 34.

The lamina material in the lower chamber 34 passing from the chamber with the air is separated from the air stream in the separator 62 and drops to the bottom of the cyclone separator. After a specified period of time, the separated lamina material is dropped from the separator through valve 68 into the container 72 where the sample is weighed and the information passed to the processor where it is stored for comparison with the stem material.

The gate valve 80 on the upper chamber is then opened and the stem material which has remained in the upper chamber is discharged through conduits 84 and 86 into the container 72 with the lamina material. The stem and lamina are weighed together and this information is passed to the processor 78 where the stem content of the sample is determined. The information can be displayed so an operator can manually vary the stemming process to ensure that the proper stem content is maintained in the threshing process or the processor can be used to automatically adjust the threshing process. The processed sample is removed from the weigh scale container 72 by the vacuum soure 90.

The processor 78 controls the function of the entire unit and in the preferred embodiment it functions as follows. As soon as the unit is activated, fan 54 and drive 36 are activated and continue to operate during an entire cycle. A cored sample 12 is taken and the scale 74 is zeroed. Mill 14 and vacuum source 16 are started. Typically the mill 14 and vacuum source 16 are operated for approximately 30 seconds and deactivated as the timed drying cycle begins. In the preferred cycle the drying step lasts approximately 4½ min. at which time the heat source 56 is deactivated allowing the unit and sample to cool by the circulation of ambient air. In the preferred cycle, drying, cooling and degradation of the sample begins and continues for approximately 10 minutes.

The air cylinder (not shown) opens gate 68 allowing lamina material to discharge onto scale hopper 72. At this time heat source 56 is reenergized to reheat system for the next cycle. The air cylinder closes gate 60 and weighing of lamina is completed and data entered in processor 78. Next, gate 80 on the upper chamber 32 opens allowing stem particles to discharge into the weigh hopper 72. At the selected interval, approximately one minute, hopper 72 containing the lamina and stem material is weighed again and the results sent to the processor. The stem percentage of the sample is calculated and displayed. Vacuum soure 90 is then energized and operates for approximately 15 seconds. When vacuum source 90 is deactivated, the apparatus is ready to process the next available sample.

This preferred embodiment can be modified in various ways, such as changing the drive mechanism, arrangement of the conduits, separating the drying and classifying portions of the apparatus into two sections, adjusting time and temperature ranges; however, these types of variations can be made to the subject invention without departing from the true spirit of the invention as defined in the following claims.

We claim:

1. An apparatus for determining the stem content of a mass of leaf comprising:

(a) size reduction and classifying means for separating the stem portion from the lamina portion of the leaf and segregating same;

(b) means for receiving and introducing said mass of leaf into said size reduction and classifying means;

(c) dryer means associated with said size reduction and classifying means for drying said mass of leaf to a proper moisture;

(d) scale means for receiving the stem and lamina portions from the size reduction and classifying means and determining the weight of said segregated stem and lamina portions; and (e) means for selectively transporting the stem and lamina portions to said scale means.

2. The apparatus of claim 1, further including processor means for receiving the weight determination from said scale means and computing the stem content of said mass of leaf.

3. The apparatus of claim 2, further including means for controlling the operating cycle of said apparatus.

4. The apparatus of claim 1, wherein said means for receiving and introducing said mass of leaf includes:

(a) mill means for receiving said mass of leaf and breaking it apart;

(b) pneumatic conveying means including a vacuum source, a collection chamber connected to said vacuum soure and a conduit between said mill means and said collection chamber whereby said mass of leaf may be transported from said mill to said chamber;

(c) a flexible conduit between said chamber and said size reduction and classifying means; and (d) a chamber valve means to contain said mass of leaf in said chamber during a selected part of an operating cycle.

5. The apparatus of claim 1, wherein said size reduction and classifying means includes:

(a) an upper and lower chamber separated by a screen of a specified mesh, said lower chamber having an exit opening and said upper chamber having an exit opening with a regulatory valve means, and regulatory valve being operated at selected time during the operating cycle;

(b) drive means for carrying and agitating said chambers;

(c) plurality of members carried within said upper chamber which are placed in motion by energizing said drive means, said members contact the sample to separate the lamina from the stem; and (d) a plenum cover carried on said upper chamber said plenum cover having an annular chamber communicating with the dryer means through a conduit in the top of said cover and with the upper chamber through a plurality of openings in the bottom wall of said cover.

6. The apparatus of claim 5, wherein said drying means includes:

(a) heater means connected to said upper chamber through the plenum cover; and (b) blower means connected to said heater for blowing air through said heater means so that heated air is directed into said upper chamber.

7. The apparatus of claim 6, wherein said means for selectively transporting the stem and lamina portions to said scale means includes:

(a) separator means including a first conduit between the lower chamber exit opening and the inlet to said separator means, said first conduit directing air flow and lamina material from the lower chamber into the separator means to separate from the lamina material from said airstream, said separator means being contiguous to said scale means whereby the lamina portion may be transported to said scale means; and (b) a second conduit means extending between the exit opening in said upper chamber and said scale means whereby when said regulatory valve means is open the stem portion carried in the upper chamber is removed by the action of said drive means and said blower means and delivered to said scale means.

* * * * *